United States Patent [19]

Leifeld

[11] Patent Number: 4,747,187

[45] Date of Patent: May 31, 1988

[54] METHOD AND APPARATUS FOR OPENING SERIALLY POSITIONED FIBER BALES

[75] Inventor: Ferdinand Leifeld, Kempen, Fed. Rep. of Germany

[73] Assignee: Trützschler GmbH & Co. KG, Monchen-Gladbach, Fed. Rep. of Germany

[21] Appl. No.: 943,936

[22] Filed: Dec. 19, 1986

[30] Foreign Application Priority Data

Dec. 21, 1985 [DE] Fed. Rep. of Germany ..... 3545686

[51] Int. Cl.[4] ..... D01G 7/06

[52] U.S. Cl. ..... 19/80 R; 19/81

[58] Field of Search ..... 19/80 R, 81

[56] References Cited

U.S. PATENT DOCUMENTS 4,514,881 5/1985 Hergeth et al. ..... 19/80 R 4,587,691 5/1986 Hösel ..... 19/80 R

FOREIGN PATENT DOCUMENTS 3334789 3/1985 Fed. Rep. of Germany .

OTHER PUBLICATIONS

"Neue Automatische Ballenöffenungsmaschinen" (New Automatic Bale Opening Machines) Melliand Textilberichte, 8/1982, p. 633.

*Primary Examiner*—Louis K. Rimrodt

*Attorney, Agent, or Firm*—Spencer & Frank

[57] ABSTRACT

A bale opener includes a carriage arranged for floor travel along a travelling path; a tower mounted on the carriage for travel therewith as a unit and for rotation relative to the carriage about a vertical axis through 180° at ends of the travelling path; an opening device mounted on the tower and projecting laterally therefrom; the opening device includes a generally horizontally supported opening roller arranged for rotation and for travel above serially positioned fiber bales for removing fiber tufts from top faces of the fiber bales. There is further provided a drive for rotating the tower through 180°. The drive includes an rpm-controllable electric motor and a control arrangement operatively connected with the electric motor for setting predetermined rpm's therefor.

5 Claims, 3 Drawing Sheets

METHOD AND APPARATUS FOR OPENING SERIALLY POSITIONED FIBER BALES

BACKGROUND OF THE INVENTION

This invention relates to a bale opener for opening fiber bales which are supported in series and which contain cotton fiber, synthetic fiber or the like. The opening is effected by detaching fiber tufts from the upper face of the bales. The removed fiber tufts are conveyed pneumatically, for example, to a tuft blending apparatus. The bale opener has a tower structure mounted on a carriage movable on rails. The tower supports a horizontally projecting opening assembly which houses the detaching mechanism proper, formed, for example, of opening rollers. The tower is rotatable about a vertical axis through 180° by means of a drive motor at the end of its path of travel.

According to the prior art, the drive means for rotating the tower about its vertical axis comprises an electrically brakable drive motor. The tower is rotated at a low speed because of its large mass. Particularly because of the significant lateral dimensions of the cantilevered opening assembly, the structure to be rotated has a large moment of inertia related to the axis of rotation. In order to ensure a gentle, shock-free rotary motion, the drive is designed for low rpm's. In this arrangement, three-phase shunt motors are used which are switched on and off and which are controlled by a control pulse for triggering rotation and by a limit switch actuated when the tower reaches its end position. The limit stops are blocking mechanisms; for effecting shock absorption, at the end of the rotation a pin projects into a fixed jaw. Such an arrangement is limited to small rpm's, requiring long periods of rotation. Since the time required for rotating the tower represents a non-productive period for the bale opener, slow tower rotations are disadvantageous in that they adversely affect the efficiency (output) of the machine. While at higher rotary speeds the lost time periods may be reduced, abrupt changes in the rotary speed expose the machine, particularly the driving and rotating elements, to disadvantageous stressing forces.

SUMMARY OF THE INVENTION

It is an object of the invention to provide an improved apparatus of the above-outlined type from which the discussed disadvantages are eliminated and which, in particular, permits a more rapid rotation of the tower while avoiding undesirable mechanical stresses on the apparatus.

This object and others to become apparent as the specification progresses, are accomplished by the invention, according to which, briefly stated, the drive means comprises an rpm-controlled electromotor which is coupled with a control device for setting predetermined rpm's.

By virtue of the invention, a rapid rotary motion may be achieved while starting and braking shocks are avoided. The electromotor for rotating the tower may be a frequency controlled three-phase drive motor, a d.c. motor, a motor with phase control or any other equivalent rpm-controllable drive. The course of rotary motion is calculated by a control system—which may be integrated in a microcomputer control—such that during the entire rotary motion, that is, in the acceleration phase, the rotary phase and braking phase, a predetermined rate of rpm change is not exceeded. The ideal course of rotary motion is controlled by the microprocessor according to an empirically determined motion characteristic such that the rpm's of the drive are, in each phase of motion, pre-applied by the microprocessor to the electric rpm setter. The rpm-controlled electromotor is connected with a control device for setting predetermined rpm's. Preferably, both in the acceleration phase and in the braking phase an at least approximately constant change in the rate of speed is maintained, while between the initial (acceleration) phase and the terminal (deceleration) phase the motor is caused to run with a zero change in the rate of speed (constant rpm). The individual phases of the rotary motion according to the invention thus are (1) the beginning of motion and the rotary acceleration phase with constant acceleration; (2) the principal rotary phase with constant speed; and (3) the braking and stopping phase with constant deceleration.

It is also feasible to cause the acceleration phase to change directly into the braking phase and ensuring that in both phases the change of the rate of speed is constant. Such an arrangement is advantageous if for safety reasons the space into which the cantilevered opening assembly swings is inaccessible for personnel and high rotary speeds are allowed.

According to the invention, the periods of rotation (that is, non-productive periods) are reduced whereby the output of the bale opener is increased. It is a further advantage of the invention that a shock-free starting and stopping of the tower structure may be achieved, resulting in a gentle handling of the machine, reducing wear thereof.

DESCRIPTION OF THE PREFERRED EMBODIMENT

Figure 1:
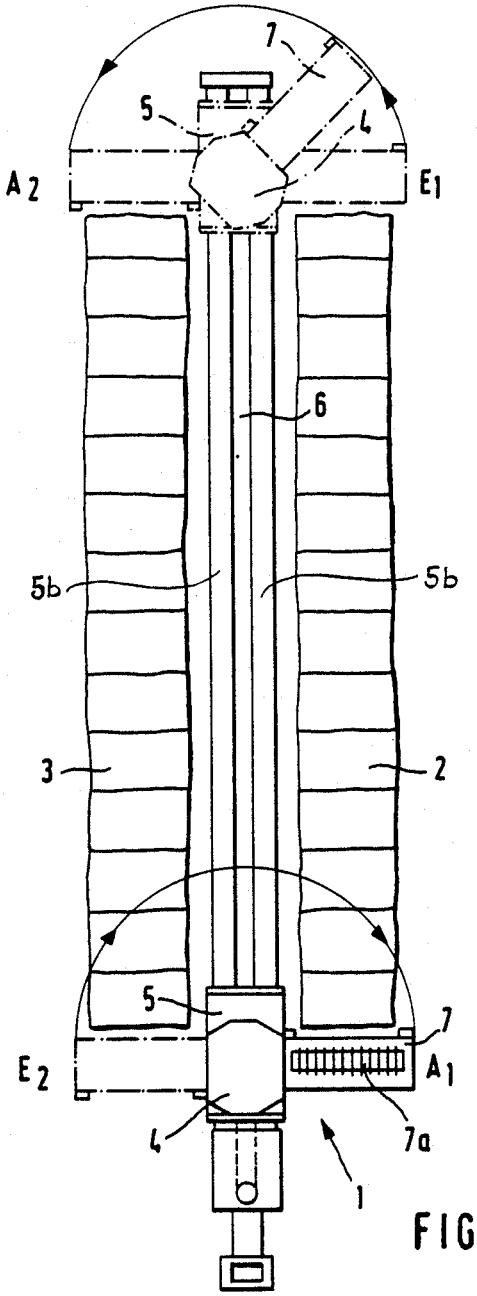
FIG. 1 is a schematic top plan view of a bale opener, incorporating the invention.
Figure 2:
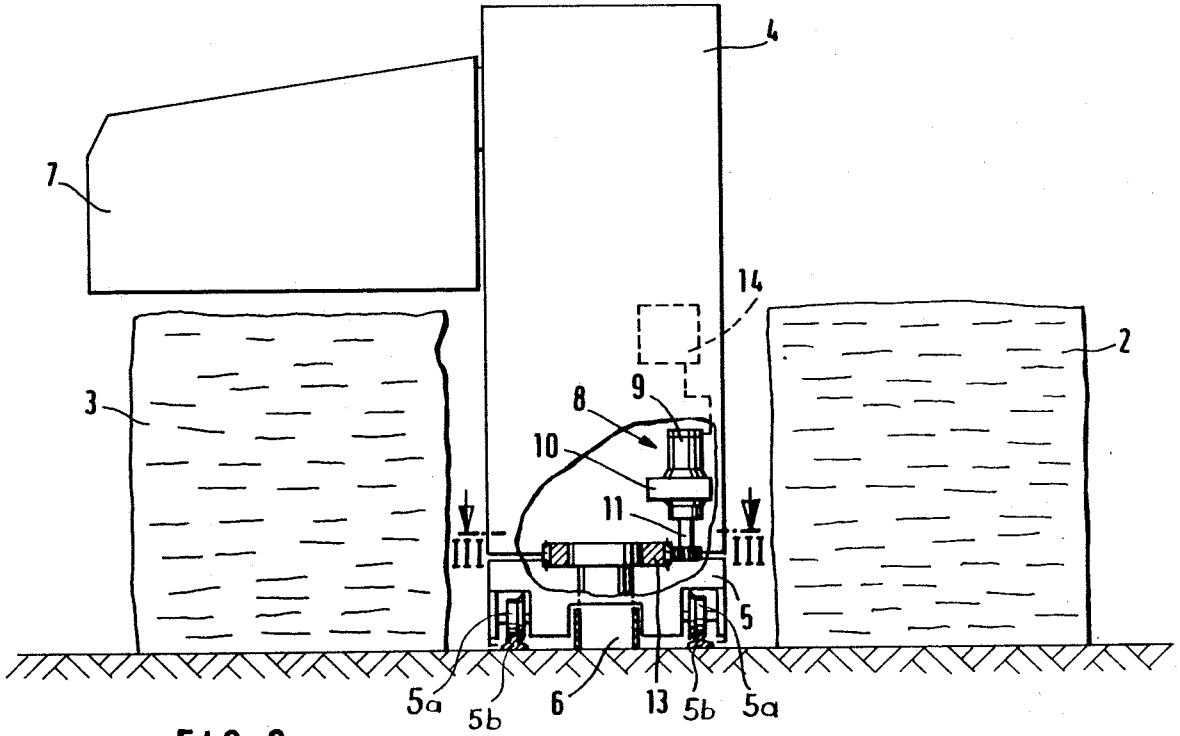
FIG. 2 is a schematic front elevational view, partially in section, of a bale opener incorporating a preferred embodiment of the invention.

Turning now to FIGS. 1 and 2, there is schematically illustrated a bale opener 1 which may be a BLENDOMAT model, manufactured by Trützschler GmbH & Co. KG, Mönchengladbach, Federal Republic of Germany. The apparatus serves for detaching fiber tufts from the top faces of serially arranged fiber bales 2 and 3 set up along both sides of the travelling path of the bale opener 1 which has a tower 4 mounted on a carriage 5 provided with wheels **5*a* to travel back and forth on rails 5*b*. The tower 4 supports an opening assembly 7 which is a cantilevered (outrigger) construction and which has a downwardly open hood-like component housing an opening roller 7*a* which detaches fiber tufts from the upper face of the fiber bales 2 and 3. The opening assembly 7 may be raised or lowered relative to the tower 4. Underneath the tower 4 there is provided a channel 6 extending between the rails 5*a* along the travelling path of the bale opener 1. The channel 6 receives the fiber tufts as they are drawn away by suction through the opening assembly 7 and the tower structure 4**.

Starting from the beginning $A_1$ of the series of fiber bales 2, the carriage 5 travels to the end $E_1$ of that fiber bale series and at location $E_1$ the tower 4, together with the opening assembly 7, is rotated about a vertical axis through 180° in a counterclockwise direction as viewed in FIG. 1. Upon completion of such a rotation, the opening assembly 7 is positioned at the beginning $A_2$ of the series formed of the fiber bales 3. Starting from the beginning $A_2$ of the series of bales 3, the carriage 5 travels to the end $E_2$ of that bale series where the tower 4, together with the opening assembly 7, is rotated 180° in a clockwise direction so that the opening assembly 7 once again assumes its position at location $A_1$ at the beginning of the fiber bale series formed of fiber bales 2.

Figure 3:
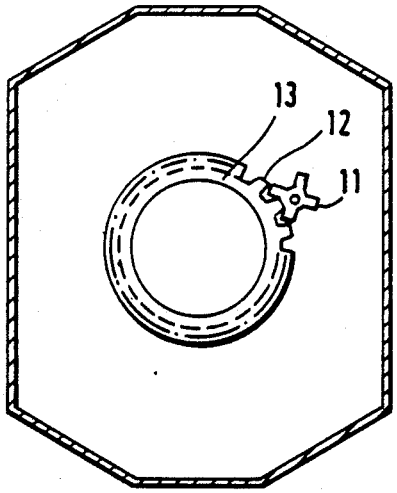
FIG. 3 is a sectional view taken along line III—III of FIG. 2.

With particular reference to FIGS. 2 and 3, the tower 4 is, together with opening assembly 7 equipped with a drive aggregate 8 for performing a rotation of at least 180° in either direction. The drive aggregate 8 comprises a motor 9 with a gearing 10 which rotates a pinion 11 meshing with external teeth 12 of a toothed ring 13 affixed to the carriage 5. A programmable control device 14 is coupled to the motor 9. The device 14 may be a microcomputer, e.g. a TMS model, manufactured by Trützschler GmbH & Co. KG, Möchenglabach, Federal Republic of Germany.

Figure 4:
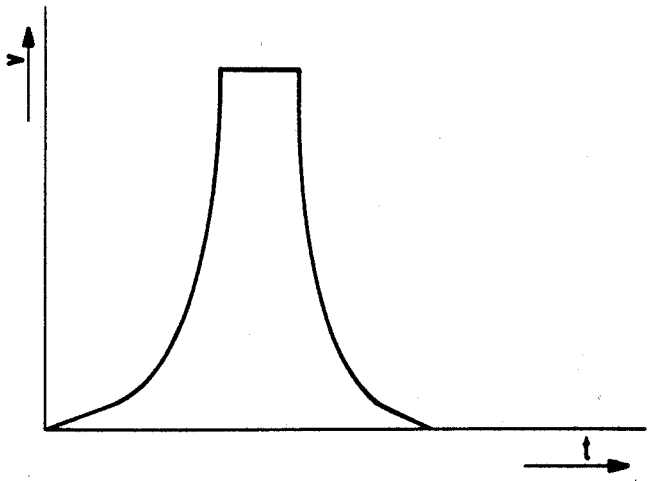
FIG. 4 is diagram illustrating the rotary speed v of an rpm-controlled electromotor as a function of time t.

Turning to the diagram illustrated in FIG. 4, there is illustrated the rpm v of the drive aggregate 8 as a function of time t. It is seen that at the beginning of rotation, the rpm v increases slowly in a generally linear manner which ensures a soft, jar-free start. Thereafter, the rpm steeply increases for a short period of time, achieving a more rapid rotation. The rotation remains constant at the highest, maximum level for a short time. Thereafter, the rpm drops steeply and eventually the rpm is reduced at a low rate in an approximately linear manner which ensures a soft, jar-free braking. The entire operation ensures thus a rapid rotation with shock-free starts and stops.

The rpm of the electromotor 9 is steplessly variable which permits a continuous (stepless) speed variation of the drive aggregate 8.

The present disclosure relates to subject matter contained in Federal Republic of Germany Patent Application No. P 35 45 686.8 (filed Dec. 21st, 1985) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a bale opener including a carriage arranged for floor travel along a travelling path; a tower mounted on the carriage for travel therewith as a unit and for rotation relative to the carriage about a vertical axis through 180° at ends of the travelling path; an opening device mounted on the tower and projecting laterally therefrom; said opening device including a generally horizontally supported opening roller arranged for rotation and for travel above serially positioned fiber bales for removing fiber tufts from top faces of the fiber bales; and drive means for rotating said tower through 180° ; the improvement wherein said drive means includes an rpm-controllable electric motor and a control means operatively connected with said electric motor for setting predetermined rpm's therefore.

2. A bale opener as defined in claim 1, wherein said electric motor is a d.c. motor.

3. A bale opener as defined in claim 1, wherein said electric motor is a frequency-controlled three-phase shunt motor.

4. In a method of operating a bale opener including a carriage arranged for floor travel along a travelling path; a tower mounted on the carriage for travel therewith as a unit and for rotation relative to the carriage about a vertical axis through 180° at ends of the travelling path; an opening device mounted on the tower and projecting laterally therefrom; said opening device including a generally horizontally supported opening roller arranged for rotation and for travel above serially positioned fiber bales for removing fiber tufts from top faces of the fiber bales; and drive means for rotating said tower through 180° ; the improvement comprising the steps of rotating said tower by said drive means in a starting phase with a constant rate of acceleration and rotating said tower by said drive means in a stopping phase with a constant rate of deceleration.

5. A method as defined in claim 4, further comprising the step of rotating said tower by said drive means with a constant speed during a phase between said starting phase and said stopping phase.

* * * * *